United States Patent [19]

Kendall et al.

[11] Patent Number: 4,589,240

[45] Date of Patent: May 20, 1986

[54] FOAM CORE PANEL WITH INTERLOCKING SKINS AND THERMAL BREAK

[75] Inventors: William F. Kendall, Oregon; Richard A. Smith; William Wadsworth, both of Dixon, all of Ill.

[73] Assignee: Raynor Manufacturing Company, Dixon, Ill.

[21] Appl. No.: 651,936

[22] Filed: Sep. 19, 1984

[51] Int. Cl.[4] ..... E04B 2/28

[52] U.S. Cl. ..... 52/309.11; 52/805; 52/588; 49/501

[58] Field of Search ..... 52/309.9, 309.11, 588, 52/805; 49/501

[56] References Cited

U.S. PATENT DOCUMENTS

| | | | |
|---|---|---|---|
| 2,008,325 | 7/1935 | Holbrook | 20/35 |
| 2,579,157 | 12/1951 | Price, Sr. et al. | 52/805 |
| 3,336,713 | 8/1967 | Privas | 52/403 |
| 3,786,613 | 1/1974 | Shepheard | 52/619 |
| 3,830,027 | 8/1974 | Paisley | 52/204 |
| 3,992,839 | 11/1976 | LaBorde | 52/275 |
| 4,123,885 | 11/1978 | Scott | 52/483 |
| 4,183,393 | 1/1980 | Bailey | 160/232 |
| 4,441,301 | 4/1984 | Benson | 52/309.11 |

*Primary Examiner*—John D. Smith
*Assistant Examiner*—K. Jaconetty
*Attorney, Agent, or Firm*—Tilton, Fallon, Lungmus

[57] ABSTRACT

A door panel having an insulating foam core and a pair of rigid inner and outer skins preferably formed of steel or other metal. The skins have side flanges with hook portions that mechanically interlock. The interlocking flanges provide a method of mechanically attaching the inner and outer skins of the panel to each other by utilizing the compression and spring back of the core during assembly. A resilient thermal barrier element is interposed between the interlocking flanges to prevent them from making direct contact with each other while at the same time sealing the joint, the thermal barrier element also including a cushioning bead engagable with a similar bead of another door panel to provide a weather seal therebetween. The method of making the panel is also disclosed.

10 Claims, 8 Drawing Figures

FOAM CORE PANEL WITH INTERLOCKING SKINS AND THERMAL BREAK

BACKGROUND

Overhead doors in which a series of door panels are hinged together, each panel having steel inner and outer skins and a foam insulating core, are well known in the art. Typically, such panels are manufactured by foaming the cores in place, usually in continuous production runs where one web of steel is unrolled from a supply roll, advanced through a forming station where its sides are folded inwardly, and coating with a liquid which upon further treatment and heat becomes the plastic foam core. A similar web of steel is unrolled from another supply roll to become the opposite skin. The inturned sides of the two steel webs are sometimes joined directly together but, more frequently, are connected to the core but not directly to each other so that a direct path of thermal conductivity between the skins is avoided. The spaces between the two skins are often bridged by resilient spacers that serve to provide a "thermal break" as well as a protective joint seal between the skins. A common characteristic of such constructions is that where a thermal break is provided the inner and outer metal skins are seldom if ever physically interlocked together. The integrity of the steel-foam-steel sandwich of such a panel is therefore maintained primarily by the bond formed between the inner surfaces of the skins and the plastic material of the core. Reference may be had to the following patents illustrative of the prior art: Nos. 4,183,393, 4,123,885, 3,336,713 (metal skins spaced apart from each other and bonded to foam cores); No. 3,786,613 (skins bonded to and interlocked with foam core without thermal break); U.S. Pat. Nos. 3,992,837, 3,830,027, 2,008,325 (inner and outer skins joined together directly or by means of splines without thermal break).

In the earlier constructions in which the side edges of the inner and outer metal skins are joined directly together, or are coupled by splines or other connecting strips, the requirements of strength, rigidity, and durability have been achieved at the expense of poor thermal barrier performance. More recent constructions in which the side edges of the skins are spaced apart, even though they may be bridged by joint seals of low thermal conductivity, function more effectively as thermal barriers but sacrifice long-term durability and strength. Over extended periods, some foam disintegration or weakening necessarily occurs with such changes often being accelerated by the gradual escape of inert gases from the foam structure and the replacement of such gases by outside air. As degradation of the foam core occurs, the forces maintaining the integrity of such a panel are diminished. Such problems are more serious where the plastic cores are foamed in place since consistency of cellular structure and uniformity of contact between the foam and the inner surfaces of the skins are difficult to achieve and control. The presence of voids or spaces where foam may be absent within the panel cannot be readily determined and such voids obviously reduce the strength of such a panel and increase the possibilities of delamination and failure.

SUMMARY OF THE INVENTION

In the door panel of this invention the inner and outer skins are interlocked together to provide a unit of high structural rigidity and durability. Even though they are physically interlocked, the skins are separated from direct contact by a resilient barrier element of low thermal conductivity. The result is a panel that has effective thermal barrier properties and also exceptional rigidity, strength, and durability.

The foam core is pre-formed rather than being foamed in place and is retained between the metal skins by bonding the core to the skins and mechanically interlocking the inner and outer skins to each other. Being pre-formed, the core material may be inspected prior to assembly to insure uniform and consistent quality. Compression of the core during assembly results in forceful adhesive contact between the core surfaces and the inner surfaces of the skins, thereby assuring secure bonding of the components.

Briefly, the panel includes a pre-formed resilient foam core sandwiched between a pair of inner and outer metal skins, the respective skins having side flanges with interlocking hook portions that physically interlock the two skins together. A resilient thermal barrier element or member is interposed between the hook portions to provide a joint seal between those skins and also to provide a resilient weatherstrip or cushioning bead for engagement with the similar strip of an adjacent panel in a complete door assembly.

During manufacture, the two skins are pressed towards each other to compress the pre-formed foam core and to position the hook portions of the side flanges for interlocking engagement when the compressive forces are relieved. The flanges may be incompletely formed at the commencement of such an assembly operation to permit clearance between the hook portions as the skins are urged towards each other during the compression step. Thereafter, the flanges are bent so that their hook portions are disposed in direct alignment. When the compressive forces are released, such hook portions, with the thermal barrier elements interposed therebetween, then shift into secure interlocking relation.

Each thermal barrier element takes the form of an extruded section of resilient plastic or rubber that is extended about one of the hook portions early in the assembly operation. Specifically, the resilient strip is attached to the outwardly-facing hook portion of one of the side flanges prior to the compression step. As the skins are then urged together to compress the resilient foam core therebetween, the side flange of the other skin with its inwardly-facing hook is forced into alignment with the opposing outwardly-facing hook so that when the compressive forces are released the two hook portions will be forced by the resilient foam core into tight interfitting relationship with the thermal barrier strip locked securely and sealingly therebetween.

Other advantages, objects, and features of the invention will become apparent from the specification and drawings.

DRAWINGS

DETAILED DESCRIPTION

Figure 1:
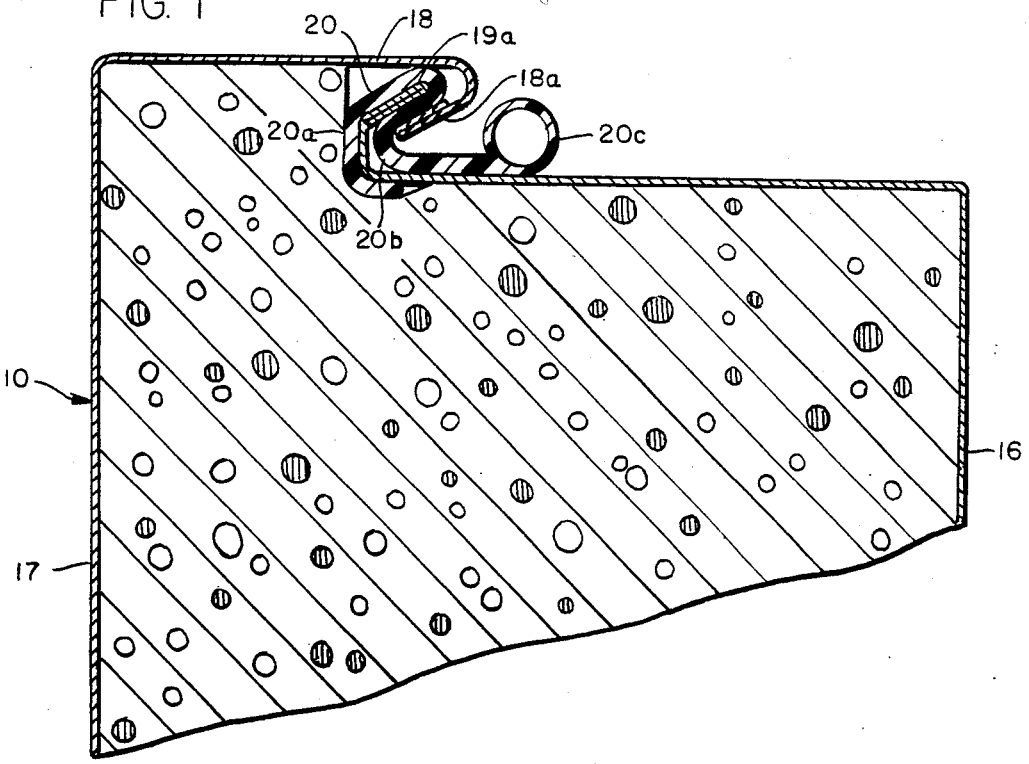
FIG. 1 is a fragmentary sectional view of a door panel showing the interlocking relationship of the metal skins, barrier element, and foam core.

Referring to the drawings, the numeral 10 generally designates a door panel for a sectional overhead door. As is well known, a plurality of such panels are joined together by hinges of the type designated by numeral 11 in FIG. 3, such hinges being equipped with rollers that ride in tracks for raising and lowering the door. Since this invention is concerned only with panel construction, further discussion of the associated elements of a complete door assembly is believed unnecessary herein.

Figure 4:
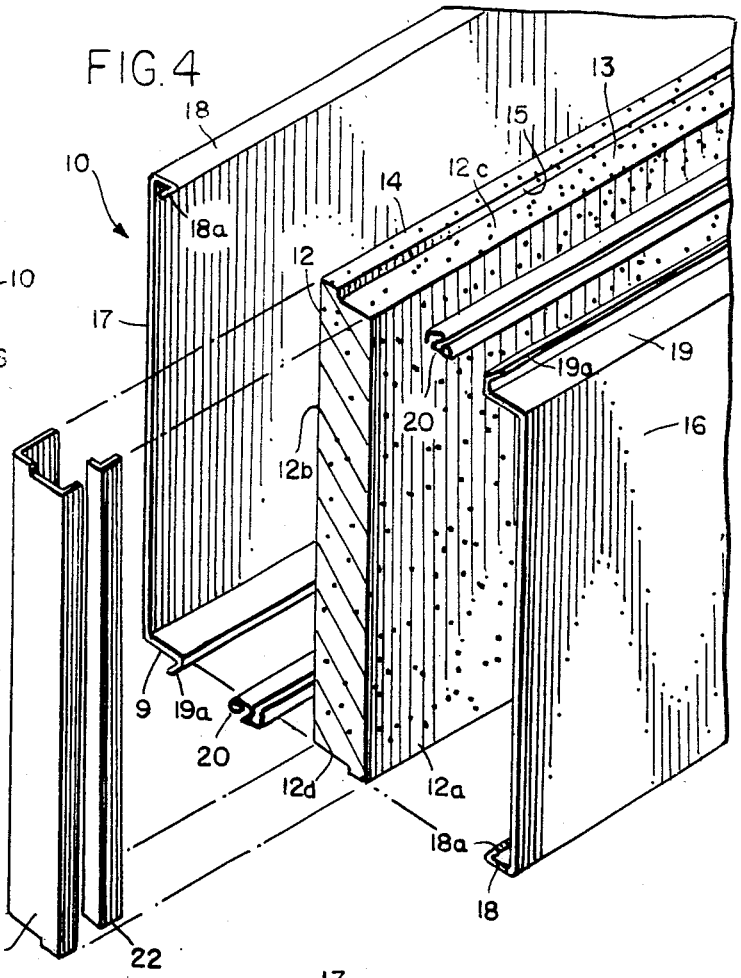
FIG. 4 is an exploded perspective view showing the several components of a door panel.

The main elements of panel 10 are shown in exploded relation in FIG. 4. The panel includes an insulating core 12 formed of any suitable resilient plastic foam. Expanded polystyrene has been found particularly effective. The core is generally rectangular in outline with parallel planar faces 12*a* and 12*b*. The upper and lower side edge surfaces 12*c* and 12*d* are stepped and, as shown most clearly in FIG. 5 the stepped configuration along opposite longitudinal (upper and lower) side edges is dimensionally the same but reversed in direction. Thus, surfaces 13 are set inwardly from surfaces 14 to define longitudinal shoulders 15 therebetween, the shoulder along one longitudinal edge facing in a direction opposite from that of the shoulder along the other longitudinal edge.

Figure 2:
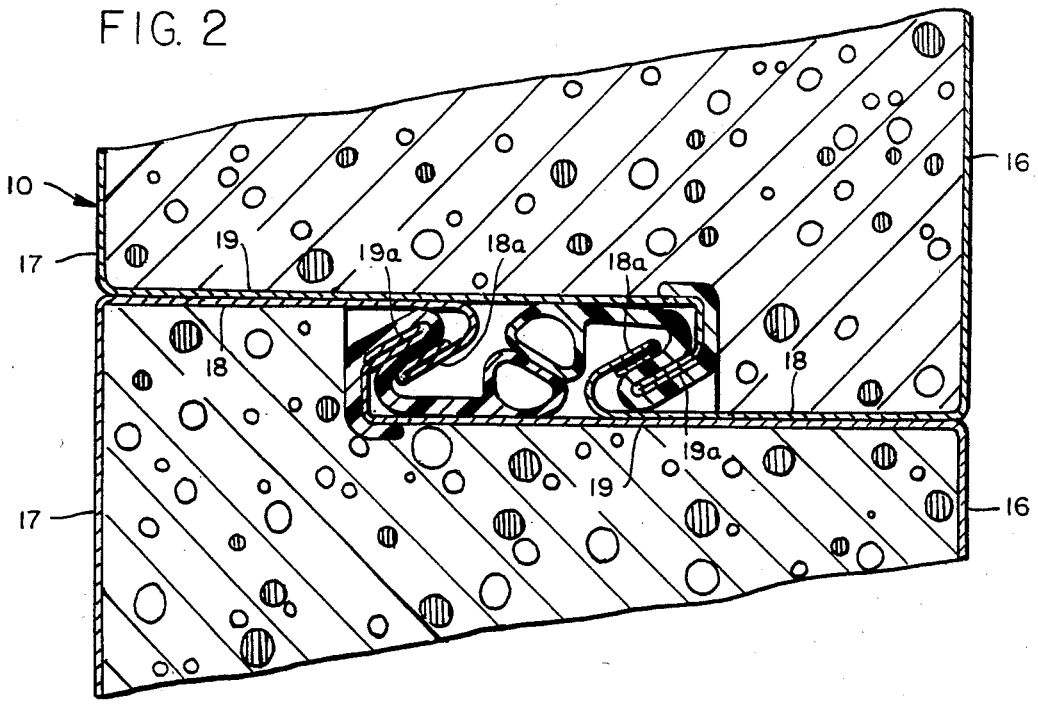
FIG. 2 is a fragmentary sectional view showing two such door sections and the sealing relationship between the thermal barrier elements of those sections.
Figure 3:
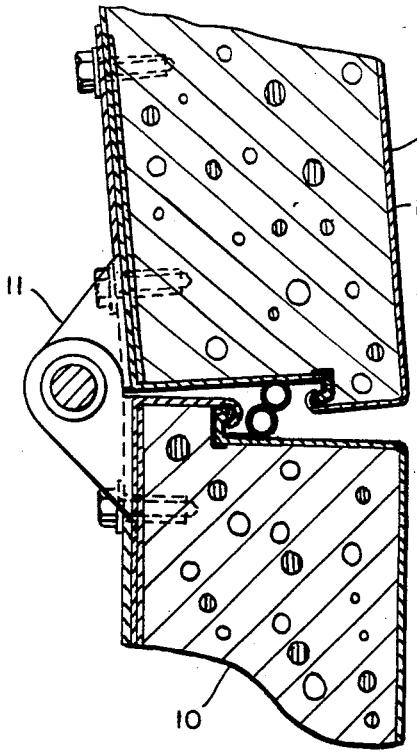
FIG. 3 is a reduced sectional view further illustrating the relationship between two adjacent door sections.

The panel also includes a pair of protective skins or shells 16 and 17 formed of sheet steel or other material (preferably metal) having similar properties. The two skins are designated by different numerals (16 and 17) to facilitate discussion and because, in the finished product, one skin 16 will define the outer surface of the panel and the other 17 the inner surface; however, both skins are identical except for their orientation. Specifically, each rectangular skin has first and second longitudinal flanges 18 and 19 extending at right angles in the same direction from the principal plane of the skin. The first flange is preferably smaller or narrower than the second and terminates along its edge in an inwardly-turned-longitudinally-extending hook portion 18*a*. The larger second flange 19 has an outwardly-turned longitudinal hook portion 19*a*. In the finished panel, hook portions 18*a* and 19*a* are interlocked with a resilient thermal barrier element 20 interposed therebetween (FIGS. 1–3).

The thermal barrier element 20 may be extruded from vinyl (i.e., polyvinyl chloride) or any other tough, durable, and resilient thermoplastic material having low thermal conductivity. As shown most clearly in FIG. 1, element 20 when viewed in transverse section has an enlarged generally C-shaped portion 20*a* that merges along one edge with a smaller C-shaped portion 20*b* nested within the first, the two C-shaped portions together enclosing the outwardly-projecting hook portion 19*a* of longitudinal flange 19. When the skins 16 and 17 are locked together, the C-shaped portions 20*a* and 20*b* of the thermal barrier element or member 20 prevent direct contact between the two hook portions. One leg of the smaller C-shaped portion 20*b* extends outwardly or externally from the interlocking zone and terminates in a longitudinally-extending hollow bead or cushion 20*c* that in an undeformed state is generally circular in cross sectional outline (FIG. 1).

The parts are proportioned and dimensioned so that cushion 20*c* is only slightly offset from the longitudinal midplane of the finished panel (FIG. 1). When two panels are fitted together as shown in FIG. 2, the cushion or bead of one engages that of the other to provide an effective weather-tight seal between the adjacent panels. The thermal barrier element 20 therefore performs the multiple functions of (a) preventing direct contact between the inner and outer skins of each panel in the area of interlock between those panels, thereby providing a thermal break between the inner and outer skins notwithstanding the interlocking relationship of their hook portions 18*a* and 19*a*, (b) sealing the interior of the panel against the entry (and exit) of gases and particulates, and (c) providing a resilient external bead or cushion that engages a similar bead of an adjacent panel to form a weather-tight seal.

In the finished panel, the remaining two side edges are closed off by suitable steel side plates 21 as illustrated in FIG. 4. The side plates may be bonded or connected to the skins by rivets, screws, adhesives, or any other suitable connecting means, it being understood that the side plates are not in contact with the outer skin 16, but rather isolated from this skin by a suitable rigid plastic or other material of low thermal conductivity 22, being inserted between the outer flange of the side plate and the outer skin 16, and that a suitable sealant material (which may be a material used for adhesive bonding) may be disposed between the flanges of the side plate and the inner and outer skins to block the passage of gases and pollutants.

Figure 5:
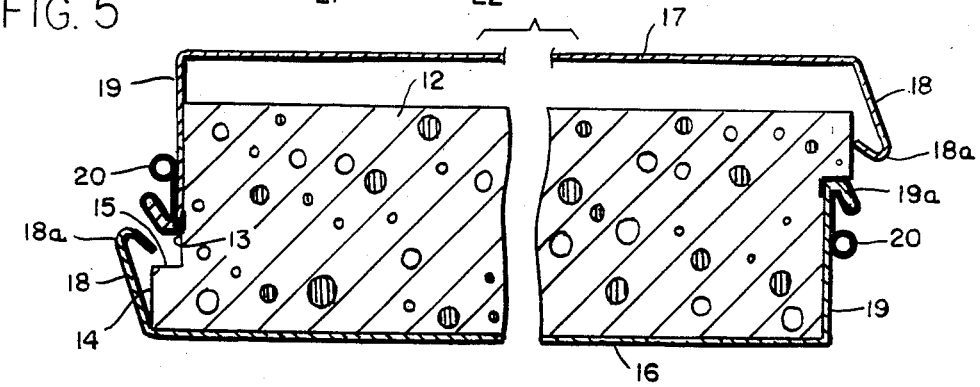
FIG. 5 is a somewhat schematic sectional view illustrating an early step in a manufacturing operation with one flange of each skin being incompletely formed.
Figure 6:
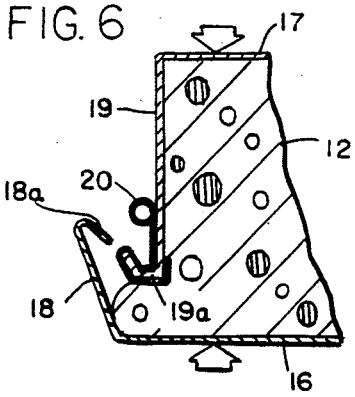
FIG. 6 illustrates the compression step in which the two skins are urged towards each other to compress the resilient pre-formed core therebetween.
Figure 8:
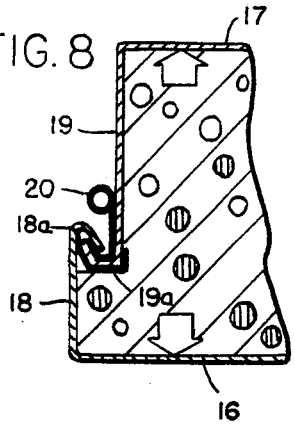
FIG. 8 illustrates the final step of relieving the compressive forces to allow outward expansion of the foam core and secure interlocking of the hook portions of the respective flanges with the thermal barrier elements secured therebetween.

In the best mode known for practicing the invention, the foam core 12 is pre-formed rather than being foamed in situ. Its initial cross sectional configuration at the commencement of an assembly procedure is as shown in FIG. 5. During assembly, the resilient core is compressed (FIG. 6) and then, after the hook portions of the metal outer skins are disposed in alignment, the compressive forces are relieved, the foam core is allowed to expand. As the foam core expands, the metal skins move apart and their hook portions shift into tight interlocking relation with the thermal barrier elements clamped therebetween (FIG. 8).

Figure 7:
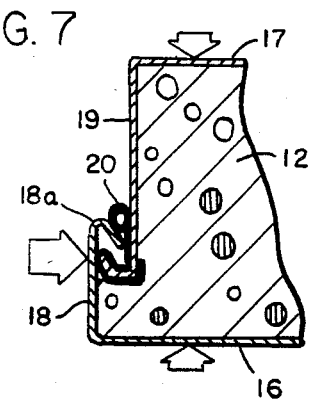
FIG. 7 depicts the step of urging the flange with its inwardly-facing hook into a final position at right angles to the remainder of the skin of which it is a part.

The compressive forces exerted upon the skins and core during the assembly procedure may be applied by any suitable means. Where each panel is formed individually in a batch operation, such compressive forces may be exerted by a pair of platens. In a continuous operation, flanges 18 and 19 are continuously formed and interlocked. The compressive means preferably comprises a series of rollers. To facilitate interlocking of the hook portions of the respective flanges, and to allow flange clearance during the compression step, it has been found desirable to form each skin with the smaller first flange 18 turned inwardly to an angle less than 90°, preferably about 75° (such angle being measured in relation to the principal plane of the skin externally of that skin). Thus, as shown somewhat schematically in FIG. 5, just prior to the compressing step the larger flanges 19 with their outwardly-turned hook portions 19*a* extend at right angles to the primary plane of each metal skin but the smaller flanges 18 with their inwardly-turned hook portions are disposed at angles less than 90° so that the compression step may proceed without interference between the hook portions of the respective skins 16 and 17 and without resistance between the foam core and inwardly-turned hook portions 18*a*. When compression of the core has been achieved to the desired extent, step-down rollers or other suitable means (not shown) force flanges 18 with their inwardly-turned hook portions into right-angled positions (FIG. 7) so that the opposing hook portions 18*a* and 19*a* may interlock when external compressive forces are relieved.

The use of pre-formed core stock has several advantages, a major one being that inspection of the core prior to assembly is possible. Voids and malformations which might occur and remain undetected when a core is foamed in place are therefore avoided. Also, the use of a pre-formed core permits the use of an aggressive adhesive for securely bonding the core to the inside surfaces of the metal skins, the result being that a more secure and stable bonding of the core material with the skins is possible when the core is pre-formed rather than being foamed in place. Any of a variety of well-known and commercially-available contact adhesives stable up to temperatures of at least 150° F. may be used.

While in the foregoing, an embodiment of the invention has been disclosed in considerable detail for purposes of illustration, it will be understood by those skilled in the art that many of these details may be varied without departing from the spirit and scope of the invention.

What is claimed is:

1. A panel comprising a planar core of generally rectangular configuration formed of resilient polymeric foam and having its opposite faces engaged and covered by a pair of flat, rectangular skins formed of rigid sheet material; each skin having a pair of inturned flanges extending at generally right angles to the plane of such skin along opposite longitudinal edges thereof; said flanges of the respective skin being provided with hook portions reversely turned with respect to each of such flanges and interlocking said skins together with said foam core therebetween; each hook portion of one skin interlocking with a hook portion of the other skin to prevent separation of said skins apart; whereby, unhooking of said interlocking hook portions would require movement of said skins towards each other with resultant planar compression of said core, and such unhooking action is therefore opposed and resisted by said core; and elongated thermal barrier members of resilient, flexible material interposed between the interlocking hook portions of said skins along each of the longitudinal edges of said panel to prevent direct contact between said skins; at least one of said thermal barrier members having an elongated, integral, and deformable bead portion disposed externally of the interlocking hook portions of said flanges to provide a resilient cushion for sealingly engaging a similar bead portion of a second panel disposed adjacent to said first-mentioned panel.

2. The panel of claim 1 in which said core has its faces adhesively bonded to said skins.

3. The panel of claim 1 in which each thermal barrier member is formed of thermoplastic material.

4. The panel of claim 1 in which said skins are formed of sheet steel.

5. A panel comprising a planar core of generally rectangular configuration formed of resilient polymeric foam and having its opposite faces engaged and covered by a pair of generally planar and rectangular sheet metal skins; each skin having a pair of inturned flanges extending generally at right angles to the plane of such skin along opposite longitudinal edges thereof; one of the flanges of each skin terminating in an outwardly and reversely turned longitudinally-elongated hook portion and the other of the flanges of such skin terminating in an inwardly and reversely turned longitudinally-elongated hook portion; said inwardly-turned and outwardly-turned hook portions of one of said skins being interlocked with the outwardly-turned and inwardly-turned hook portions, respectively, of the other of said skins; said resilient core being disposed between said skins and urging said skins outwardly to maintain the respective hook portions thereof in interlocking relation; and a pair of elongated thermal barrier members of flexible thermoplastic material interposed between the interlocking hook portions of said skins and preventing direct contact between said interlocking hook portions; each thermal barrier member including an elongated, integral, bead portion disposed externally of the interlocking hook portions of said flanges to provide a resilient cushion along each longitudinal edge of said panel.

6. The panel of claim 5 in which said core has its faces adhesively bonded to said skins.

7. The panel of claim 5 in which said skins are formed of sheet steel.

8. A method of forming a panel for overhead doors and the like, comprising the steps of pre-forming two generally, flat rectangular, rigid metal skins to provide each with a pair of inturned side flanges along opposite longitudinal edges thereof; the flanges of each skin having hook portions capable of interlocking with the hook portions of the other of said skins to define a space between said skins for receiving a thermally-insulating foam core; positioning said skins along opposite sides of a resilient, planar foam core having a thickness in an uncompressed state greater than the width of said space; urging said skins towards each other to compress said core therebetween and advance the hook portions of said flanges into aligned relation so that upon release of said compressive forces the restorative forces exerted by said resilient foam core will urge said hook portions of the two skins into interlocking relation; interposing resilient thermal barrier elements between the hook portions of the two skins to prevent direct contact between said skins when said compressive forces are released; and thereafter releasing the compressive forces exerted on the skins so that the restorative forces exerted by said resilient foam core urge and maintain said hook portions in interlocking relation and retain said thermal barrier elements in place.

9. The method of claim 8 in which certain of said flanges of said skins are subjected to a second forming operation following the step of compressing said core to align said hook portions for interlocking when said compressive forces are released.

10. The method of claim 8 in which there is the further step of adhesively bonding said foam core to said skins.

* * * * *